US007946810B2

(12) United States Patent
Towsley et al.

(10) Patent No.: US 7,946,810 B2
(45) Date of Patent: May 24, 2011

(54) MULTISTAGE PUMP ASSEMBLY

(75) Inventors: Greg Towsley, Lenexa, KS (US); Ryan Haack, Lawrence, KS (US); Joshua Talley, Lawrence, KS (US); Svend Amdisen, Olathe, KS (US)

(73) Assignee: Grundfos Pumps Corporation, Olathe, KS (US)

( * ) Notice: Subject to any disclaimer, the term of this patent is extended or adjusted under 35 U.S.C. 154(b) by 888 days.

(21) Appl. No.: 11/868,860

(22) Filed: Oct. 8, 2007

(65) Prior Publication Data

US 2008/0085185 A1 Apr. 10, 2008

Related U.S. Application Data

(60) Provisional application No. 60/850,871, filed on Oct. 10, 2006.

(51) Int. Cl.
*F01D 1/02* (2006.01)

(52) U.S. Cl. ..... 415/198.1; 415/199.1; 415/203; 415/204; 415/206

(58) Field of Classification Search ..... 415/99, 415/10, 101, 103, 198.1, 199.1, 204, 206, 415/100, 203

See application file for complete search history.

(56) References Cited

U.S. PATENT DOCUMENTS 2,753,807 A * 7/1956 Lung ..... 415/199.2
3,543,368 A * 12/1970 Marlow ..... 29/889
3,841,791 A 10/1974 Doolin
4,025,225 A * 5/1977 Durant ..... 415/90
4,098,558 A 7/1978 Bush et al.
4,116,583 A 9/1978 Budris
4,190,395 A 2/1980 Ball
4,244,675 A 1/1981 Bower
4,305,214 A 12/1981 Hurst
4,421,456 A 12/1983 Huffman
4,479,756 A 10/1984 Sieghartner
4,669,956 A 6/1987 Brunel et al.
4,676,717 A 6/1987 Willyard, Jr. et al.
4,789,301 A 12/1988 Osborne et al.
4,842,480 A * 6/1989 Jensen et al. ..... 415/199.1
4,877,372 A 10/1989 Jensen et al.
4,900,224 A 2/1990 Timperi et al.
4,923,367 A 5/1990 Zimmer
4,930,996 A 6/1990 Jensen et al.
5,006,053 A 4/1991 Seno
5,040,946 A 8/1991 Caoduro
5,201,633 A * 4/1993 Peu ..... 415/146
5,302,091 A 4/1994 Horiuchi
5,336,048 A 8/1994 Ganzon et al.
5,380,162 A * 1/1995 Evans et al. ..... 417/223
5,407,323 A 4/1995 Gay et al.
5,478,215 A 12/1995 Kobayashi et al.
5,494,403 A 2/1996 Kobayashi et al.

(Continued)

FOREIGN PATENT DOCUMENTS

EP 0 726 397 A4 8/1996

(Continued)

*Primary Examiner* — Igor Kershteyn
(74) *Attorney, Agent, or Firm* — The Small Patent Law Group; Dean Small; Jay J. Hoette

(57) ABSTRACT

A modular multistage pump assembly includes a volute having a suction side and a pressure side, a pump stack having at least one stage, and a modular flange coupled to each of the volute and the pump stack.

22 Claims, 4 Drawing Sheets

U.S. PATENT DOCUMENTS 5,599,164 A 2/1997 Murray
5,601,419 A 2/1997 Kobayashi et al.
5,676,528 A * 10/1997 Kobayashi et al. ..... 417/247
5,704,768 A * 1/1998 Kobayashi et al. ..... 417/62
5,752,803 A 5/1998 Wetzel et al.
5,755,554 A 5/1998 Ryall
5,797,731 A 8/1998 Kobayashi et al.
5,846,052 A 12/1998 Kameda
5,873,697 A 2/1999 Gully
5,888,053 A 3/1999 Kobayashi et al.
5,906,479 A 5/1999 Hawes
5,913,657 A 6/1999 Mollenhauer
5,961,301 A 10/1999 Wasserman et al.
5,993,151 A 11/1999 Paulsen et al.
6,082,960 A * 7/2000 Fandrey et al. ..... 415/55.1
6,116,851 A 9/2000 Oklejas, Jr.
6,126,392 A 10/2000 Sabini
6,135,723 A 10/2000 Hatton
6,190,119 B1 2/2001 Roth et al.
6,196,813 B1 3/2001 Turley et al.
6,203,294 B1 3/2001 Turley et al.
6,227,796 B1 5/2001 Markovitch
6,227,802 B1 5/2001 Torgerson et al.
6,361,280 B1 3/2002 Furnas
6,398,493 B1 6/2002 Chien et al.
6,422,838 B1 7/2002 Sloteman
6,439,835 B1 8/2002 Chien et al.
6,551,058 B2 4/2003 Nowack
6,648,606 B2 11/2003 Sabini et al.
6,776,584 B2 8/2004 Sabini et al.
6,779,974 B2 8/2004 Chien
6,799,943 B2 10/2004 Racer et al.
6,893,219 B2 * 5/2005 Conti ..... 415/199.1
6,918,307 B2 7/2005 Ohlsson et al.
7,104,766 B2 9/2006 Mascola
7,117,120 B2 10/2006 Beck et al.
7,296,981 B2 11/2007 Strong
2001/0036404 A1 11/2001 Nagaoka et al.
2005/0093246 A1 5/2005 Dietle et al.
2005/0095150 A1 5/2005 Leone et al.
2005/0147505 A1 7/2005 Kuroiwa et al.
2006/0127232 A1 6/2006 Urban et al.
2006/0269404 A1 11/2006 Volk

FOREIGN PATENT DOCUMENTS

EP 1 431 584 A2 6/2004
WO WO 92/18776 10/1992
WO WO 98/34030 8/1998

* cited by examiner

MULTISTAGE PUMP ASSEMBLY

CROSS-REFERENCE TO RELATED APPLICATIONS

This application claims the benefit of U.S. Provisional Application No. 60/850,871 filed Oct. 10, 2006, the subject matter of which is expressly incorporated herein by reference in its entirety.

BACKGROUND OF THE INVENTION

This invention relates generally to pump assemblies, and more particularly, to multistage end-suction pump assemblies.

Pump assemblies are provided within pipe systems of residential, commercial or industrial facilities for increasing the pressure and flow of the fluid within the pipe system. The pump assembly is usually fitted to the pipe system to circulate the fluid under pressure. The typical pump assembly has an inlet that supplies fluid to the pump through a manifold having an impeller chamber, an impeller located in the chamber, a power head (e.g. motor and shaft) to drive the impeller, and an outlet that returns the fluid to the pipe system. The inlet is fitted to a supply pipe and the outlet is fitted to a discharge pipe. The size of the pump assembly is selected based on the particular pipe system and the desired pressure and flow of the fluid within the pipe system. For example, various pump assembly components may be provided to accommodate various sized supply pipes and discharge pipes, which are typically different than one another. The particular pump assembly components chosen depend on the particular application. In another example, in applications where a high pressure is desired, a pump assembly having a relatively larger motor or a relatively larger impeller may be used. In some known pump assemblies, multiple impellers are used, such as in a multistage pump assembly.

The multistage pump assemblies typically have one of two configurations, namely a horizontal configuration and a vertical configuration. In both configurations, the pump assemblies typically stack the multiple impellers in stages in series. In the horizontal configuration, the stack is oriented generally horizontally when installed; and in the vertical configuration, the stack is oriented generally vertically when installed.

In a typical horizontal configuration, the manifold having the inlet is positioned at one end of the stack and the outlet is positioned within a pump head at the opposite end of the stack. These types of pump assemblies include a motor shaft being supported by a shaft bearing within the motor. The impellers are directly coupled to the motor shaft. A drawback with this type of configuration is the number of stages that may be used is limited, due to the drive capacity of motor and the weight of the shaft and the impellers on the shaft bearing. Additionally, this design is complicated to manufacture and assemble. Additionally, repair and/or replacement of the pump head is difficult and requires that the majority of the pump assembly (e.g. the manifold, each stage, and the pump head) be completely disassembled for servicing.

In a typical vertical configuration, the inlet and outlet are both provided in a common manifold and are axially aligned with one another such that the pump assembly is fit within a line of the pipe system. The in-line orientation of the inlet and outlet is limited to particular applications that allow for in-line connection to the standard pipe system. A problem encountered with this type of connection occurs in installing the pump assembly into an existing pipe system, particularly in retro-fitting, replacing or upgrading an existing system with a new pump assembly. The existing pipe system may not allow for an in-line connection. As such, these types of pump assemblies are not suitable for all applications.

BRIEF DESCRIPTION OF THE INVENTION

In one aspect, a modular multistage pump assembly is provided including a volute having a suction side and a pressure side, a pump stack having at least one stage, and a modular flange coupled to each of the volute and the pump stack.

In another aspect, a multistage end-suction pump assembly is provided including a pump stack extending between a volute end and a head end, wherein the pump stack includes at least one stage of impellers aligned to rotate about a rotation axis. The pump assembly also includes a volute coupled to the volute end of the pump stack, wherein the volute includes an inlet and an outlet being oriented non-parallel with respect to one another.

DETAILED DESCRIPTION OF THE INVENTION

Figure 1:
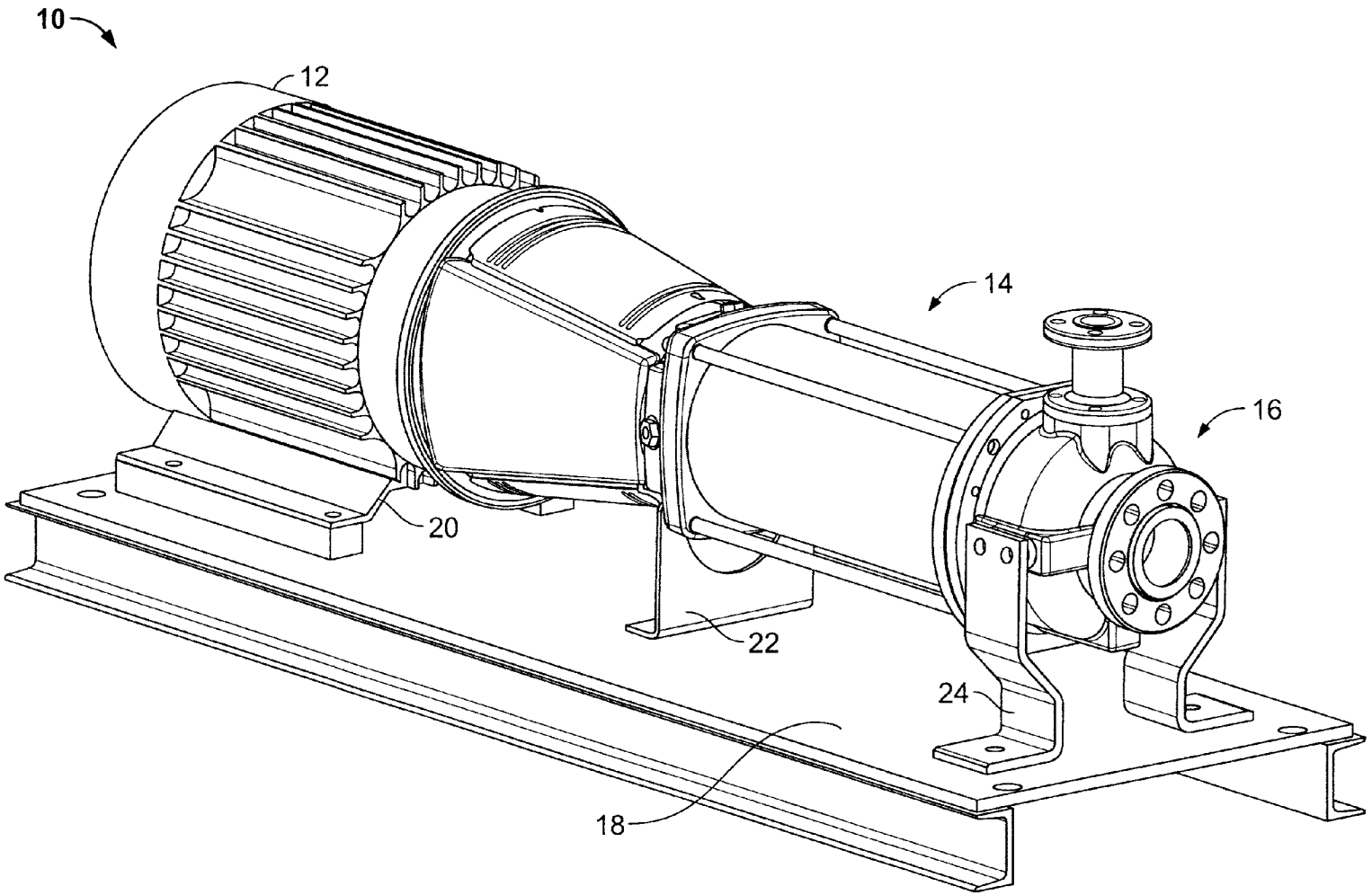
FIG. 1 is a side perspective view of a pump assembly formed in accordance with an exemplary embodiment.

FIG. 1 is a side perspective view of a pump assembly 10 formed in accordance with an exemplary embodiment. The pump assembly 10 includes a pump motor 12, a multistage pump stack 14 and a volute 16. The pump assembly 10 may be installed in an existing or new pipe system to a supply pipe and a discharge pipe (not shown) for increasing the pressure and/or flow of water or another fluid within the pipe system. In the illustrated embodiment, the pump assembly 10 represents a horizontal pump assembly that may be mounted to a base 18 via a plurality of supports or braces, such as motor supports 20, a pump stack support 22, and volute supports 24. The base 18 is generally planar and is oriented horizontally, and may be mounted, directly or indirectly to a ground or building surface (not shown). While various embodiments of horizontal pump assemblies are described below, it is understood that the pump assembly 10 may be beneficial in other, non-horizontal applications as well. The following embodiments are therefore provided for illustrative purposes only.

Figure 2:
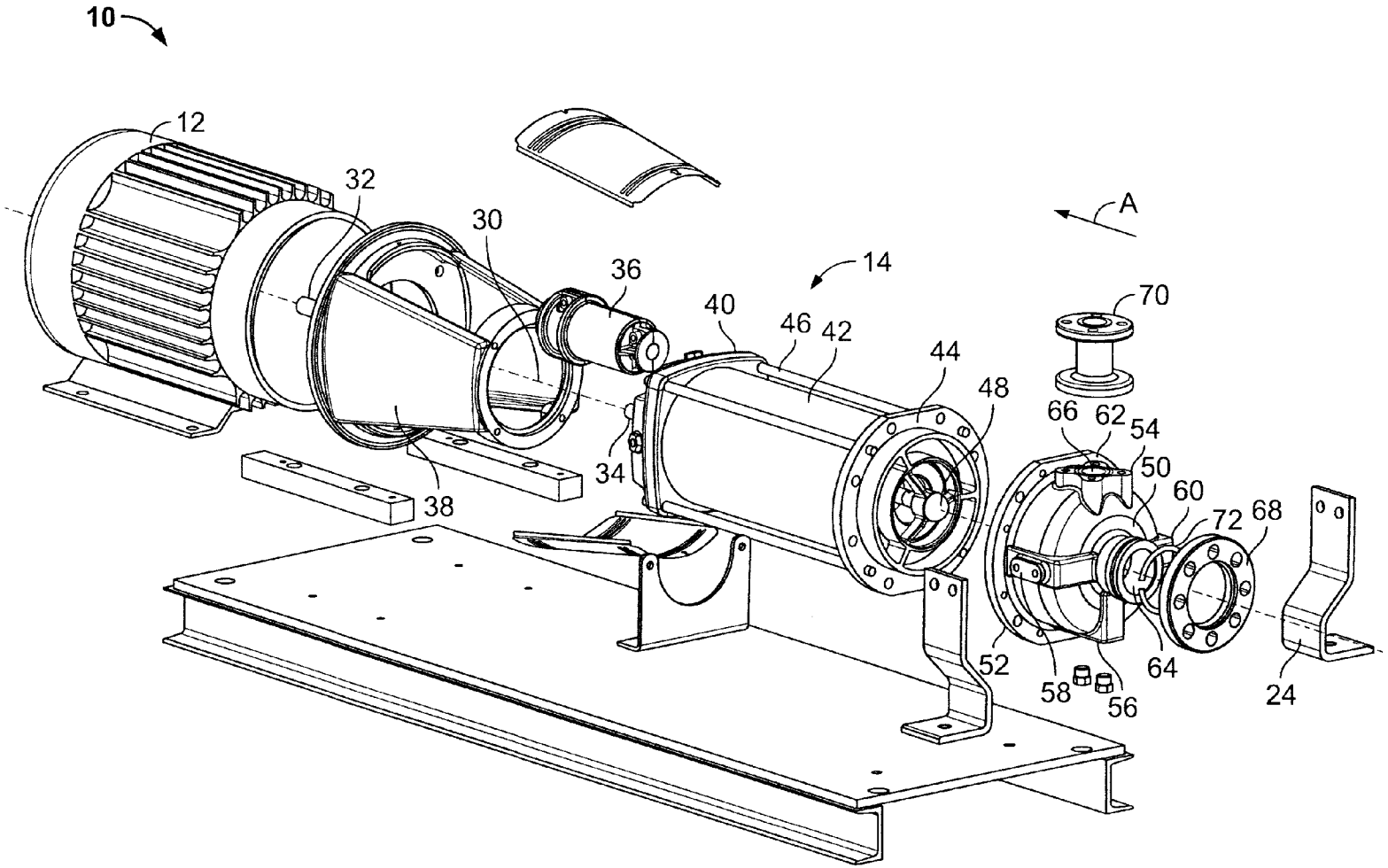
FIG. 2 is an exploded view of the pump assembly shown in FIG. 1.

FIG. 2 is an exploded view of the pump assembly 10, illustrating the motor 12, the pump stack 14 and the volute 16 being axially aligned with one another along a longitudinal or rotation axis 30. The motor 12 includes a motor shaft 32 aligned with the rotation axis 30, and the pump stack 14 includes a pump shaft 34 aligned with the rotation axis 30. The motor shaft 32 and the pump shaft 34 are interconnected by a shaft coupling 36 for transferring rotational movement from the motor shaft 32 to the pump shaft 34. The shaft coupling 36 is housed within an enclosure 38 extending between the motor 12 and the pump stack 14.

The pump stack 14 includes a pump head 40 and a sleeve 42 extending from the pump head 40 to a sleeve flange 44 opposite the pump head 40. The sleeve 42 has a generally circular cross section and defines a chamber through which the fluid flows. In the illustrated embodiment, and as will be explained in greater detail below, the pump stack 14 includes an inner chamber and an outer chamber through which the fluid is channeled. The sleeve 42 defines a radially outer surface of the outer chamber. The sleeve flange 44 is separately provided from, and coupled to, the sleeve 42. The sleeve flange 44 is retained in place with respect to the sleeve 42 and the pump head 40 by multiple staybolts 46 extending between the pump head 40 and the sleeve flange 44. The pump shaft 34 extends through the pump stack 14 and is substantially centered within the chamber defined by the sleeve 42. Optionally, an end of the pump shaft 34 may be supported by a bearing support 48 integrated with the sleeve flange 44.

The volute 16 includes a front end 50, a rear end 52, a top 54, a bottom 56, and sides 58 and 60. The volute supports 24 may be coupled to the sides 58, 60 using known fasteners or known fastening methods. The volute 16 is coupled to the sleeve flange 44 via a volute flange 62 extending radially outward at the rear end 52 of the volute 16, such as using known fasteners and known fastening methods. The volute 16 is coupled to the sleeve flange 44 such that the volute 16 is in fluid communication with the pump stack 14.

In the illustrated embodiment, the volute 16 represents an end-suction volute having an inlet 64 at the front end 50 and an outlet 66 at the top 54. The inlet 64 and the outlet 66 are non-parallel with respect to one another, such that the volute 16 has a non-in-line configuration (e.g. an orientation in which the inlet and the outlet are not aligned with one another along an axis). Optionally, the inlet 64 and the outlet 66 may be generally perpendicular with respect to one another, such as the end-suction, 90 degree discharge configuration illustrated in FIG. 2. Optionally, the inlet 64 is oriented in-line with the rotation axis 30 such that the fluid flows through the inlet 64, the volute 16, the sleeve flange 44 and the pump stack 14 in a direction along the rotation axis 30, shown by the arrow A. Other configurations and orientations of the inlet and outlet 64 and 66 are contemplated in alternative embodiments, such as on the front end 50, top 54, bottom 56 or sides 58, 60 in a non-in-line configuration.

In the illustrated embodiment, the volute 16 includes an inlet fitting 68 and an outlet fitting 70 coupled to the inlet 64 and outlet 66, respectively. The fittings 68, 70 are separately provided from the volute 16 and mountable thereto. The fittings 68, 70 may be securely coupled to the volute 16 using known fasteners or fastening methods. For example, the fittings 68, 70 may be threadably coupled to the volute 16; the fittings 68, 70 may be coupled to the volute 16 using a integral flanges and corresponding fasteners; the fittings 68, 70 may be soldered or welded to the volute 16; and the like. The fittings 68, 70 are also configured for attachment to the supply and discharge pipes, respectively, such as by a flange coupling, a threaded coupling, a soldered coupling, and the like. The type and size of fitting 68, 70 (e.g. flange, threaded, and the like) may be selected based on the type of mating fitting included on the supply and discharge pipes. A modular volute 16 is thus provided that may be adapted for installation to an existing piping system. Optionally, the types of fittings 68, 70 may be the same and/or the size of the opening of the fittings 68, 70 may be the same. Alternatively, the type and/or size of the fittings 68, 70 may be different than one another. In the illustrated embodiment, the outlet fitting 70 constitutes a modular discharge spool having first and second flanges at the ends thereof. Multiple discharge spools may be provided with the pump assembly 10, wherein each spool has different dimensions, such as opening size, flange size, height, width, length, thickness, fitting type, and the like. The discharge spools are interchangeable with the volute 16 to accommodate a range of discharge pipe configurations. In the illustrated embodiment, the inlet fitting 68 constitutes a victaulic connection using a snap ring 72 and corresponding grooves on each of the inlet fitting 68 and the volute 16 at the inlet 64. The inlet fitting 68 also includes a flange for interconnection with the supply pipe, however, other types of interconnection may be accomplished in lieu of the flange coupling. Optionally, multiple fittings may be provided with the pump assembly 10, wherein each fitting has different dimensions, such as opening size, flange size, height, width, length, thickness, fitting type, and the like. The multiple fittings are interchangeable with the volute 16 to accommodate a range of supply pipe configurations. In alternative embodiments, other connecting methods and devices may be employed, such as a threaded coupling, a welded or soldered coupling, and the like. Optionally, seals may be positioned between the fittings 68, 70 and the volute 16 to seal the interconnection therebetween. In alternative embodiments, the fittings 68, 70 may be integrally formed with the volute 16 and positioned for interconnection with the supply and discharge pipes.

Figure 3:
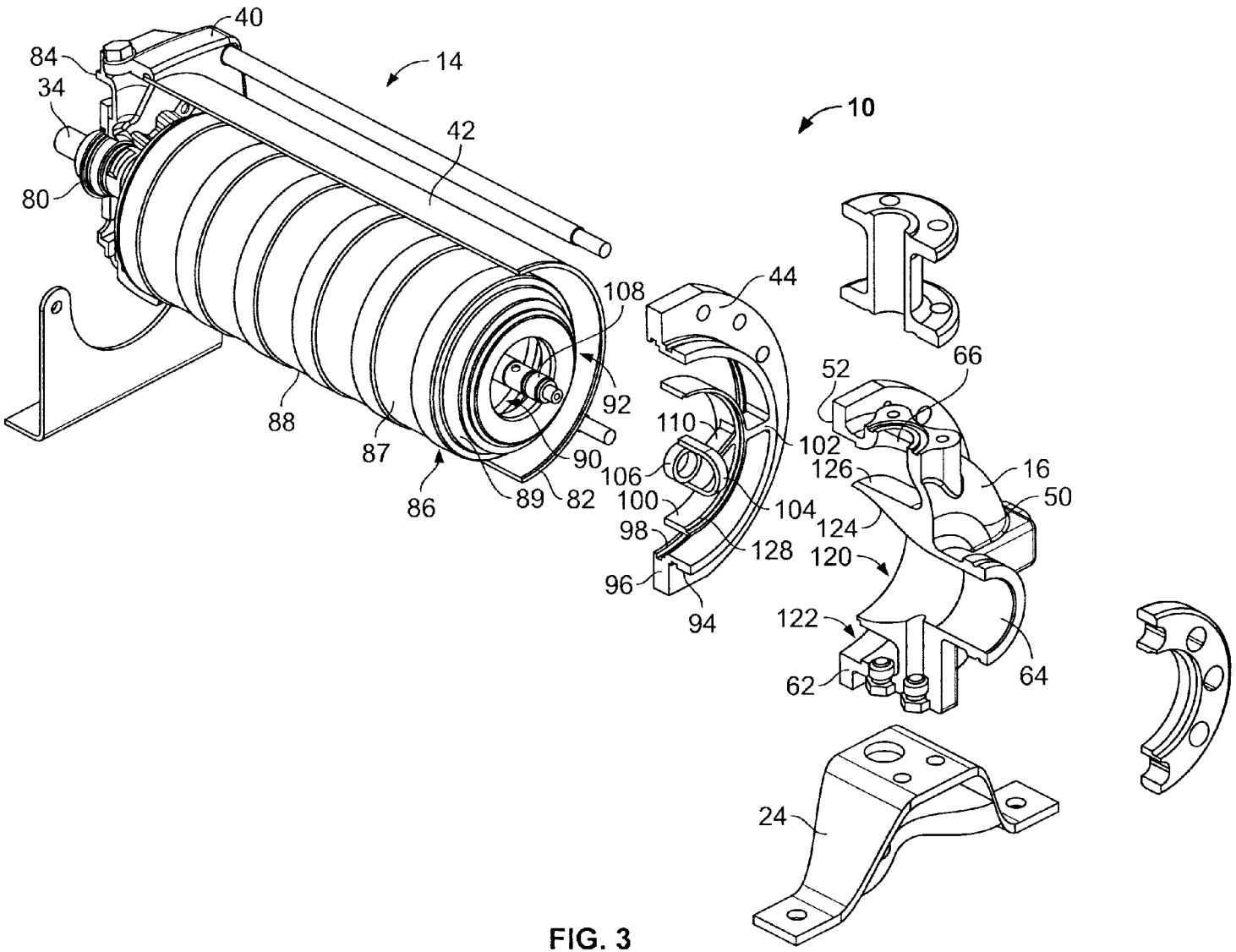
FIG. 3 is a partial cutaway view of the pump assembly shown in FIG. 2.

FIG. 3 is an exploded, partial cutaway view of the pump assembly 10 illustrating the pump head 40, the sleeve 42, the sleeve flange 44 and the volute 16 being cutaway. As illustrated in FIG. 3, the pump stack 14 includes a seal cartridge 80 located between the pump head 40 and the pump shaft 34. The seal cartridge 80 seals against fluid leakage from the pump stack 14 at the pump head 40. The pump shaft 34 is rotatable within the seal cartridge 80 and the seal cartridge 80 operates to seal the fluid from escaping from the pump stack 14.

The pump stack 14 extends from a first end 82 to a second end 84 and includes multiple stages of impeller assemblies 86 between the first and second ends 82, 84. Any number of stages may be provided depending on the particular application and the desired flow rate or pressure of the pump assembly 10. The first end 82 is located proximate the volute 16, and in the exemplary embodiment, the sleeve flange 44 is coupled to the first end 82. The second end 84 is located proximate the pump head 40, and in the exemplary embodiment, the pump head 40 defines the second end 84. The impeller assemblies 86 each include an impeller (not shown) therein that is coupled to the pump shaft 34. The impeller rotates to channel the fluid through the corresponding stage. Optionally, each impeller assembly 86 includes a diffuser 87 shaped to force the fluid from an upstream stage to a downstream stage as the fluid is pumped from the first end 82 to the second end 84. Each stage includes a single impeller and a single diffuser 87. Additionally, the first impeller assembly 86 includes a diffuser represented by suction interconnector 89 at the upstream end of the first stage. The suction interconnector 89 is sized to interconnect the sleeve flange 44 and the downstream diffusers 87. In the illustrated embodiment, the suction interconnector 89 includes a necked down portion having a reduced diameter at the end thereof for joining with the sleeve flange 44. Optionally, at least one of the stages may constitute a bearing stage that includes a bearing for supporting the pump shaft 34. Such bearing stages are used more often in longer pump stacks 14.

The impeller assemblies 86 include an outer surface 88 spaced radially outward from the pump shaft 34 and spaced radially inward from the sleeve 42. A suction, or radially inward, chamber 90 is positioned between the outer surface 88 of the impeller assemblies 86 and the pump shaft 34. The impellers are positioned within the suction chamber 90. A discharge, or radially outward, chamber 92 is positioned between the outer surface 88 of the impeller assemblies 86 and the sleeve 42. The suction and discharge chambers 90, 92 are axially aligned, but radially split or spaced with respect to one another. The suction chamber 90 is in fluid communication with, and extends between the inlet 64 of the volute 16 and the discharge chamber 92, and the discharge chamber 92 is in fluid communication with, and extends between the suction chamber 90 and the outlet 66 of the volute 16.

As described above, the sleeve flange 44 is located at the first end 82 of the pump stack 14. The sleeve flange 44 includes an outer surface 94, from which a flange portion 96 of the sleeve flange 44 extends. The volute flange 62 is coupled to the flange portion 96 during assembly of the pump assembly 10. The outer surface 94 has a substantially circular cross section and is sized substantially the same as the sleeve 42. Optionally, the outer surface 94 defines an extension of the sleeve 42 wherein an end of the outer surface 94 abuts the first end 82 of the sleeve 42 and continues upstream from the sleeve 42. Alternatively, the outer surface 94 may be slightly larger than the sleeve 42 such that the sleeve 42 may fit within the outer surface 94 in sealing engagement. Optionally, a seal (not shown) may be positioned between the outer surface 94 and the sleeve 42 for sealing the connection therebetween. The seal and/or the sleeve 42 may be received within an annular groove 98 in the outer surface 96. Optionally, the annular groove 98 is positioned at a rear end of the sleeve flange 44.

The sleeve flange 44 further includes a concentric ring 100 positioned radially inward with respect to the outer surface 94. The concentric ring 100 is positioned to separate water flowing within the suction chamber 90 from water flowing within the discharge chamber 92. Optionally, the concentric ring 100 operates as an extension of the outer surface 88 of the impeller assemblies 86. The concentric ring 100 is supported and positioned by braces 102 extending between the concentric ring 100 and the outer surface 96.

Optionally, the sleeve flange 44 may include a bearing support 104 at a central portion of the sleeve flange 44. The bearing support 104 includes a mating bearing 106 that engages with a corresponding mating bearing 108 of the pump shaft 34. The bearing support 104 operates to support the mating bearings 106, 108 and the pump shaft 34. The bearing support 104 is supported by braces 110 extending between the concentric ring 100 and the bearing support 104.

The volute 16 includes an inner chamber 120 and an outer chamber 122. The inner chamber 120 is in fluid communication with the inlet 64 and the outer chamber 122 is in fluid communication with the outlet 66. The inner chamber 120 extends between the inlet and the concentric ring 100 of the sleeve flange 44, and restricts fluid flow directly between the inlet 64 and the outlet 66. In the illustrated embodiment, the inner chamber 120 is axially aligned with the inlet 64 and the suction chamber 90 of the pump stack 14 and extends axially along the rotation axis 30. The inner chamber 120 channels all of the fluid entering the inlet 64 to the suction chamber 90 via the sleeve flange 44. Optionally, the inner chamber 120 includes a transition section 124 that changes size from the upstream end to the downstream end. In the illustrated embodiment, the transition section 124 increases in diameter from the upstream end to the downstream end. The diameter of the inner chamber 120 is substantially equal to the diameter of the concentric ring 100. Optionally, registers 126 and 128 are provided on each of the concentric ring 100 and the volute 16 at the rear end 52 where the volute 16 is joined to the sleeve flange 44.

The outer chamber 122 extends between the front end 50 and the rear end 52 of the volute 16. The outer chamber 122 is positioned radially outward with respect to the inner chamber 120, and completely surrounds the inner chamber 120. The outer chamber 122 is axially aligned with the outer chamber 92 of the pump stack 14 and receives fluid therefrom and directs the fluid to the outlet 66.

In the embodiment of FIG. 3, the volute support 24 is represented by a bottom support at the bottom 56 of the volute 16.

Figure 4:
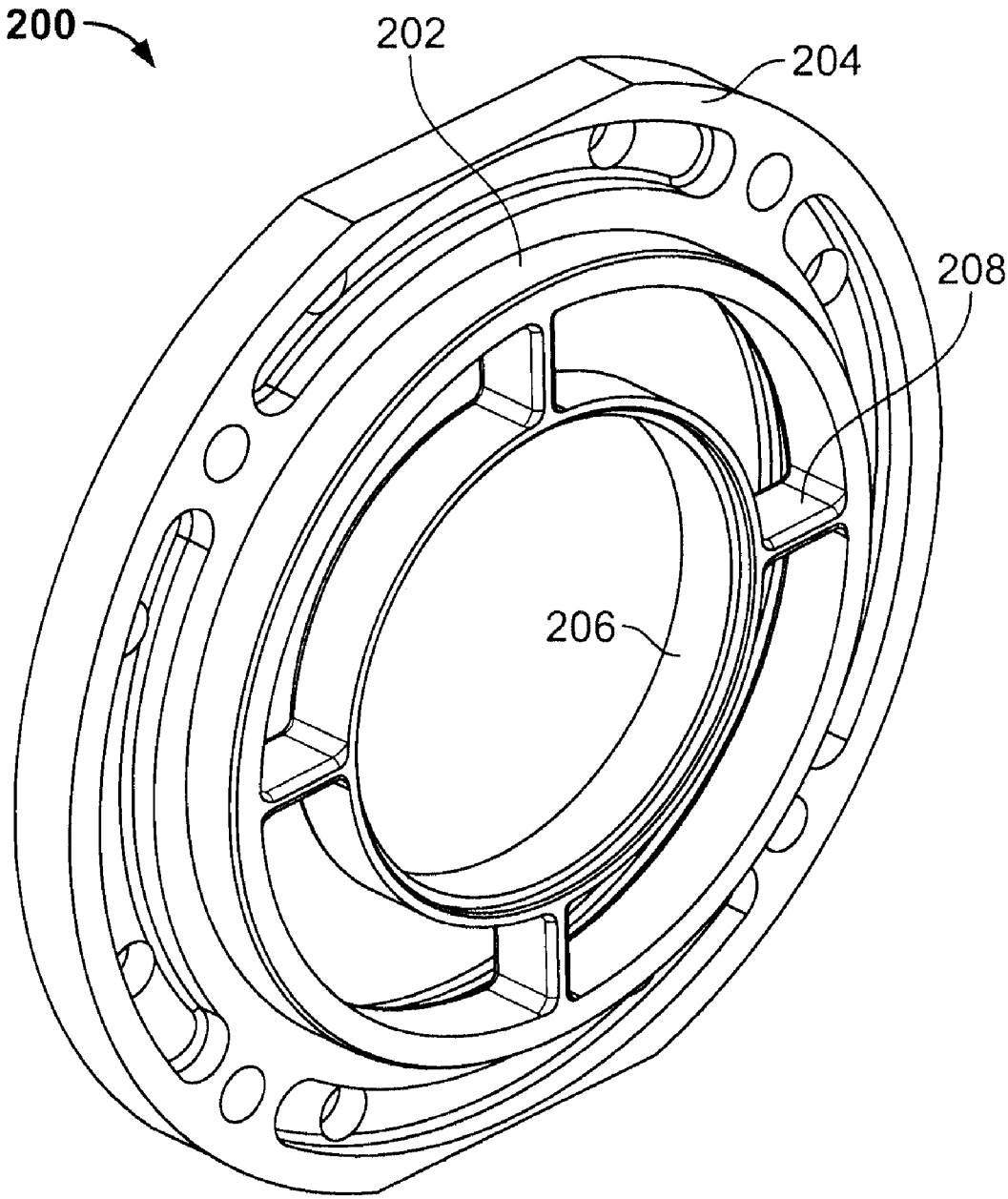
FIG. 4 is a side perspective view of an alternative sleeve flange for the pump assembly shown in FIG. 1.

FIG. 4 is a side perspective view of a sleeve flange 200 for the pump assembly 10 and formed in accordance with an alternative embodiment. The sleeve flange 200 includes an outer surface 202, from which a flange portion 204 of the sleeve flange 44 extends. The outer surface 202 is dimensioned to interface with the sleeve 42 and the volute 16 (both shown in FIG. 3) in a similar manner as the sleeve flange 44 described above. The sleeve flange 200 further includes a concentric ring 206 positioned radially inward with respect to the outer surface 202. The concentric ring 206 is dimensioned and positioned to interface with the sleeve 42 and the volute 16 in a similar manner as the sleeve flange 44 described above. The concentric ring 206 is supported and positioned by braces 208 extending between the concentric ring 206 and the outer surface 202. The sleeve flange 200 does not include a bearing support. The sleeve flange 200 is open radially inward from the concentric ring 206 and fluid is able to flow unobstructed therethrough.

An exemplary operation of the pump assembly 10 will be described below with reference to FIGS. 1-3. In operation, water or another fluid enters the volute 16 at the inlet 64 via the inlet fitting 68 from the supply pipe. In the illustrated embodiment, the fluid flows axially through the inlet 64 and through the volute 16 to the pump stack 14. Between the inlet 62 and the outlet 64, the fluid is pumped through the multistage pump stack 14, wherein the pressure of the fluid is increased based on the number of stages within the pump stack 14. Within the pump stack 14, the fluid initially passes through the suction interconnector 89 of the first, or upstream, stage of the pump stack 14. The suction interconnector 89 defines the upstream end of the suction chamber 90. The fluid is channeled by the suction interconnector 89 and/or the diffuser 87 into a bottom runner or impeller of the first pump stage, and the impeller forces the fluid to the diffuser 87 of the first stage. The diffuser 87 of the first stage channels the fluid into the impeller of the second stage. Correspondingly, a plurality of stages may be arranged one after another depending on the pressure differential required. For example, any number of pump stages may be selected depending on the particular outlet fluid requirements, such as flow. pressure, and the like, and sleeves 42 of various lengths may be provided to accommodate the chosen number of pump stages. The staybolts 46 may also be sized accordingly. Optionally, the pump assembly 10 may include a single stage.

Once the fluid is forced through the last pump stage, the fluid is conveyed to the discharge chamber 92. The fluid is channeled through the discharge chamber 92 to the outer chamber 122 of the volute 16. The outer surface 88 of the impeller assemblies 86 separates and isolates the inner and outer chambers 90, 92. Similarly, the concentric ring 100 separates or isolates the fluid flowing between the inner chambers 90, 120 from the fluid flowing between the outer chambers 92, 122. The fluid within the annular space of the outer chamber 122 of the volute 16 is expelled from the volute 16 through the outlet 66 and into the discharge pipe.

While the invention has been described in terms of various specific embodiments, those skilled in the art will recognize that the invention can be practiced with modification within the spirit and scope of the claims.

What is claimed is:

1. A modular multistage pump assembly comprising:

a volute having a suction chamber and a pressure chamber, the volute having an inlet supplying fluid to the suction chamber and being configured to receive the fluid from a supply pipe, the volute having an outlet receiving fluid from the pressure chamber and being configured to supply the fluid to a discharge pipe;

a pump stack having multiple stages, the pump stack receiving fluid from the volute and supplying pressurized fluid to the volute; and a modular flange coupled to each of the volute and the pump stack between the volute and the pump stack.

2. A pump assembly in accordance with claim 1, wherein the modular flange is separately provided from each of the volute and the pump stack.

3. A pump assembly in accordance with claim 1, wherein the modular flange defines a suction chamber defining a flow path between the suction chamber of the volute and the pump stack, and the modular flange defines a pressure chamber defining a flow path between the pump stack and the pressure chamber of the volute.

4. A pump assembly in accordance with claim 1, wherein the volute comprises one of a first type and a second type, the modular flange being configured to be coupled to each of the first type volute and the second type volute.

5. A pump assembly in accordance with claim 1, wherein the volute comprises one of a first size and a second size, the modular flange being configured to be coupled to each of the first size volute and the second size volute.

6. A pump assembly in accordance with claim 1, wherein the pump stack comprises one of a first type and a second type, the modular flange being configured to be coupled to each of the first type pump stack and the second type pump stack.

7. A pump assembly in accordance with claim 1, wherein the pump stack comprises one of a first size and a second size, the modular flange being configured to be coupled to each of the first size pump stack and the second size pump stack.

8. A pump assembly in accordance with claim 1, wherein the modular flange includes a bearing support configured to support a shaft of the pump stack.

9. A multistage end-suction pump assembly comprising:

a pump stack extending between a volute end and a head end, the pump stack including multiple stages of impellers aligned to rotate about a rotation axis;

a modular flange coupled to the volute end of the pump stack; and a volute coupled to the modular flange, the volute includes an inlet and an outlet being oriented non-parallel with respect to one another.

10. A pump assembly in accordance with claim 9, wherein the inlet is parallel with the rotation axis.

11. A pump assembly in accordance with claim 9, wherein the inlet is oriented in-line with the rotation axis.

12. A pump assembly in accordance with claim 9, wherein the inlet and outlet are oriented perpendicular with respect to one another.

13. A pump assembly in accordance with claim 9, wherein the modular flange includes a suction chamber defining an unimpeded flow path between a suction chamber of the volute and the pump stack, and wherein the modular flange includes a pressure chamber defining an unimpeded flow path between the pump stack and a pressure chamber of the volute.

14. A pump assembly in accordance with claim 9, wherein the modular flange is separately provided from each of the volute and the pump stack.

15. A pump assembly in accordance with claim 9, wherein the volute includes a transition section extending from the inlet to increase the size of a suction chamber within the volute.

16. A pump assembly in accordance with claim 9, wherein the inlet and the outlet each include an opening, each opening being of substantially the same diameter.

17. A pump assembly in accordance with claim 9, further comprising a pressure fitting coupled to the outlet, the pressure fitting extending between a first end and a second end, the first end being configured to interconnect with a pressure side pipe, and the pressure fitting having an opening extending therethrough.

18. A pump assembly in accordance with claim 9, further comprising:

a shaft extending along the rotating axis and coupled to each of the impellers; and a motor coupled to the shaft for rotating the shaft about the rotation axis.

19. A pump assembly in accordance with claim 9, wherein the pump stack includes a sleeve defining an outer periphery of the pump stack, the modular flange interconnecting the sleeve and the volute.

20. A pump assembly in accordance with claim 9, wherein the modular flange includes concentric rings defining a radially inner channel in direct fluid communication with the inlet and a radially outer channel in direct fluid communication with the outlet.

21. A pump assembly in accordance with claim 9, wherein the pump stack includes at least two stages of diffusers abutting one another to define an axially extending tube, and the pump stack includes an axially extending sleeve being radially spaced outward with respect to the tube, the tube defining a suction channel along the inner portion of the tube and the tube and the sleeve cooperating to define a pressure channel therebetween, the suction channel being in fluid communication with the inlet and the pressure channel being in fluid communication with the outlet.

22. A pump assembly in accordance with claim 9, wherein the modular flange includes a bearing support configured to support a shaft of the pump stack.

* * * * *